US005627429A

United States Patent [19]

Iwasaki

[11] Patent Number: 5,627,429

[45] Date of Patent: May 6, 1997

[54] COLOR CATHODE RAY TUBE HAVING AN INTERMEDIATE LAYER BETWEEN A FACE PLATE AND A TRICOLOR PHOSPHOR LAYER

[75] Inventor: Yasuo Iwasaki, Nagaokakyo, Japan

[73] Assignee: Mitsubishi Denki Kabushiki Kaisha, Kyoto, Japan

[21] Appl. No.: 883,171

[22] Filed: May 15, 1992

[30] Foreign Application Priority Data

May 24, 1991 [JP] Japan ..... 3-119977
May 24, 1991 [JP] Japan ..... 3-119979

[51] Int. Cl.[6] ..... H01J 29/30

[52] U.S. Cl. ..... 313/474; 313/112; 313/466

[58] Field of Search ..... 313/466, 473, 313/477 R, 479, 474, 112, 480; 359/885, 889

[56] References Cited

U.S. PATENT DOCUMENTS

| | | | |
|---|---|---|---|
| 3,114,065 | 12/1963 | Kaplan . | |
| 4,132,919 | 1/1979 | Maple | 313/466 |
| 4,465,337 | 8/1984 | Baron et al. | 313/466 |
| 4,634,926 | 1/1987 | Vriens et al. | 313/479 |
| 4,717,856 | 1/1988 | Kato | 313/466 |
| 4,728,856 | 3/1988 | Iwasaki et al. | 313/480 |
| 4,804,883 | 2/1989 | Muller et al. | 313/479 |
| 4,945,282 | 7/1990 | Kawamura et al. | 313/479 |
| 4,987,338 | 1/1991 | Itou et al. | 313/479 |
| 5,068,568 | 11/1991 | De Vrieze et al. | 313/474 |
| 5,177,400 | 1/1993 | Iwasaki | 313/474 |
| 5,179,318 | 1/1993 | Maeda et al. | 313/474 |
| 5,200,667 | 4/1993 | Iwasaki et al. | 313/479 |

FOREIGN PATENT DOCUMENTS

| | | |
|---|---|---|
| A20350995 | 1/1990 | European Pat. Off. . |
| A30350995 | 1/1990 | European Pat. Off. . |
| 2629268 | 9/1989 | France . |
| 2642897 | of 1990 | France . |
| 3222434A1 | 12/1983 | Germany . |

*Primary Examiner*—Sandra L. O'Shea
*Assistant Examiner*—Vip Patel

[57] ABSTRACT

A color cathode ray tube includes an intermediate layer between the face plate and the tricolor phosphor layer. The intermediate layer is a selective light absorption layer or a neutral filter layer. The selective light absorbing function and the uniform light absorbing function are imparted, not to the functional film on the outer surface of the face plate, but to the intermediate layer formed on the surface of the face plate facing the electron gun, namely, on the inner surface of the face plate. The mechanical strength of the functional film is thus enhanced.

24 Claims, 10 Drawing Sheets

COLOR CATHODE RAY TUBE HAVING AN INTERMEDIATE LAYER BETWEEN A FACE PLATE AND A TRICOLOR PHOSPHOR LAYER

BACKGROUND OF THE INVENTION

1. Field of the Invention

The present invention relates to a color cathode ray tube having a selective light absorption layer which not only includes a selective light absorption layer or a neutral filter layer formed over the inner surface of the face plate, but also includes a functional film such as an antistatic film and a low reflection film formed over the outer surface of the face plate.

2. Description of the Related Art

With the recent increase in the size of a color cathode ray tube and the improvement in the brightness and the focus control, a voltage to be applied to a phosphor screen of the cathode ray tube, namely, the acceleration voltage of an electron beam has been increased. For example, a voltage as high as 30 to 34 kV is applied to the phosphor screen of a recent color cathode ray tube having a size of not less than 30 inches.

As a result, the outer surface of the face plate of the color cathode ray tube is apt to be charged up particularly when the power of a television set is turned ON or OFF. Since the charged-up outer surface of the face plate attracts small dust particles floating in the air and is tainted thereby, the brightness of the cathode ray tube is impaired. In addition, when a viewer approaches the outer surface of the charged-up face plate, an electric discharge occurs, which disadvantageously brings discomfort to the viewer.

Antistatic type color cathode ray tubes having a functional film have come into general use in order to prevent such a build up of charge on the outer surface of the face plate. In these cathode ray tubes, a smooth transparent conductive film is formed over the outer surface of the face plate so as to release the charges on the face plate to ground.

FIG. 13 is an explanatory view of the principle of the antistatic effect of the above-described color cathode ray tube having an antistatic type functional film. In FIG. 13, the reference numeral 6 represents a neck portion which has an electron gun (not shown) therein, 7 a deflection yoke, 4*a* a funnel portion, 4 a face plate, and 5 a high voltage button. The deflection yoke 7 is connected to the power supply for deflection through a lead wire 7*a*. The electron gun is connected to the power supply for acceleration through a lead wire 6*a* and the high voltage button 5 is connected to a high voltage power supply through a lead wire 5*a*. The electron gun provided in the neck portion 6 emits electron beams toward the face plate 4. The deflection yoke 7 electromagnetically deflects these electron beams from the outside of the cathode ray tube. The high voltage power supply applies a high voltage to the phosphor screen provided on the inner surface of the face plate 4 through the high voltage button 5. The applied high voltage accelerates the electron beams, and when the phosphor screen of the face plate is bombarded with the electron beams, the phosphor screen is excited by the energy produced by the bombardment and emits light. In this way, an optical output is taken out of the phosphor screen. By the influence of the high voltage applied to the phosphor screen provided on the inner surface of the face plate 4, the electric potential on the outer surface of the face plate 4 changes, as described above, thereby causing a problem such as the adhesion of dust particles.

In order to prevent such a problem, in the color cathode ray tube having an antistatic type functional film shown in FIG. 13, a smooth transparent conductive film, namely, an antistatic type functional film 1 is formed over the outer surface of the face plate 4, and the antistatic type functional film is connected to a grounding wire 10 through a conductive tape 11, with an implosion preventive metal band 8 and ears 9 welded thereto. In this way, the charges generated on the face plate 4 are constantly released to ground 10A, thereby preventing charge-up.

Since the smooth transparent conductive film 1, namely, the antistatic type functional film formed over the outer surface of the face plate 4 is required to have a certain degree of mechanical strength, that is, a certain degree of hardness and adhesiveness, a silica ($SiO_2$) film is generally used as the functional film 1.

In one of the conventional methods of forming the smooth transparent conductive silica film, namely, antistatic type silica functional film, an alcohol solution of silicon (Si) alkoxide including a functional group such as an —OH group and an —OR group is uniformly and smoothly applied onto the outer surface of the face plate of the color cathode ray tube by spin coating or the like. Thereafter the coating film is sintered at a relatively low temperature, for example, at a temperature not higher than 100° C.

FIG. 14 is a schematic enlarged sectional view of an antistatic type functional film 13 produced by forming a porous silica ($SiO_2$) film 12 on the outer surface of the face plate 4 by the above-described method. On the inner surface of the face plate 4 is formed a conventional phosphor screen composed of a black light absorbing layer 14, a BGR phosphor layer 15 and a metal-backed layer 16.

Since the smooth transparent conductive silica ($SiO_2$) film 12 formed by the above-described method is porous and includes a silanol group (=Si-OH), it is possible to reduce the surface resistivity of the face plate 4 by absorbing the water content in the air. However, if the porous silica ($SiO_2$) film 12 is used in a dry environment for a long time, the water content retained in the porous film is evaporated and the surface resistivity increases with time.

To solve this problem thoroughly, the following method is adopted. Fine particles of tin oxide ($SnO_2$), indium oxide ($In_2O_3$) or the like are dispersed in and mixed with an alcohol solution of silicon (Si) alkoxide as a conductive filler. A trace amount of phosphorus (P) or antimony (Sb) is further added to the solution in order to impart a semiconducting property thereto. The coating liquid obtained in this way is uniformly and smoothly applied to the outer surface of the face plate by spin coating or the like, and the face plate coated with the coating liquid is sintered at a comparatively high temperature (e.g., 100° C. to 200° C.).

FIG. 15 is a schematic enlarged sectional view of a phosphor screen for explaining an antistatic type functional film 17 formed in the above-described manner. Since conductive filler particles 18 exist in the porous silica ($SiO_2$) film 12 formed over the outer surface of the face plate 4, it is possible to produce the stable antistatic type functional film 17 the surface resistivity of which does not change with time in any environment.

With the recent strong demand for a high picture quality with a color TV, a method including both the above-described antistatic treatment and the improvement in the contrast and the color tone of the light emitted from a color cathode ray tube by coloring the transparent conductive film formed over the face plate or controlling the transmittance of the functional film 17 has begun to be put into practical use.

That is, a selective light absorbing coating liquid or a uniform light absorbing coating liquid is produced by mixing the particles of an inorganic or organic pigment or dye with a coating liquid for forming the conventional antistatic type functional film 13 as a base so as to color the coating liquid. The thus-obtained coating liquid is applied to the outer surface of the face plate 4 of a color cathode ray tube by spin coating. In this way, a color cathode ray tube is completed which is provided with an antistatic type selective light absorption film or an antistatic type uniform light absorption film which has not only an antistatic function, but which also has a filter function for selectively absorbing light or uniformly absorbing light as a functional film.

FIG. 16 is a schematic enlarged sectional view of a phosphor screen for explaining an antistatic type selective light absorption film or an antistatic type uniform light absorption film 19 formed in the above-described manner. The particles 20 of an inorganic or organic pigment or dye in addition to conventional filler particles 18 are dispersed in and mixed with the porous silica ($SiO_2$) film 12.

FIG. 17 explains the optical characteristics of the antistatic type selective light absorption film 19. In FIG. 17, the curve B shows a spectrum distribution of the relative luminous intensity of blue luminescence on the phosphor screen of the color cathode ray tube, the main spectrum wavelength thereof being about 450 nm. Similarly, the curves G and R show the relative luminous intensities of green luminescence and red luminescence, respectively, the main spectrum wavelengths thereof being about 535 nm and 625 nm, respectively. Each of the curves (III) and (IV) shows a spectral transmittance distribution of the face plate 4 with the phosphor screen of the color cathode ray tube formed thereon. The curve (III) shows a spectral transmittance distribution of a clear type face plate 4 having a spectral transmittance of about 85% in the visible light region, while the curve (IV) shows a spectral transmittance distribution of a tint type face plate 4 having a spectral transmittance of about 50% in the visible light region.

It is obvious from the relationships between the spectral distributions and the relative luminous intensities of the phosphor screens which are indicated by the curves B, G and R, that as the spectral transmittance of the face plate becomes lower, the brightness of the color cathode ray tube is lowered still further. However, when the spectral transmittance is low, since external light incident on the phosphor screen is effectively eliminated, the contrast is enhanced. Therefore, with the recent tendency of placing enphasis on the color television picture quality, the tint type face plate 4 has become widespread.

The curve (I) shows one example of the spectral transmittance distribution of the antistatic type selective light absorption film 19 formed over the outer surface of the face plate 4 in order to enhance the contrast control, as described above. The distribution has the main absorption peak (K) at 585 nm between the main spectrum wavelengths of the relative luminous intensities G and R. The distribution has sub absorption peaks L and M at 495 nm between the main spectrum wavelengths of the relative luminous intensities B and G, and at 410 nm on the short wavelength side of the main spectrum wavelength of the relative luminous intensity B, respectively.

Since the main absorption peak K is coincident with a range of a relatively high spectral luminous efficacy of human eyes, it is preferable from the point of view of contrast control that the light component in this range is absorbed and removed from the external light (white light). The sub absorption peaks L, M have a small degree of contrast control enhancing effect, but has a rather greater effect on the control of the original color of the phosphor screen itself. If only the main absorption peak K is provided, the yellow light component is only removed from external light (white light) and the original color of the phosphor screen itself becomes purplish blue. The original color of the phosphor screen is preferably an achromatic color from the point of view of picture quality, and a purplish blue phosphor screen is undesirable because it cannot reproduce the pure black color. These two sub absorption peaks L, M can balance the original color of the phosphor screen so that it may have an achromatic color.

FIG. 18 is another example of the optical characteristics of the antistatic type selective light absorption film 19. The curve (II) shows an example of the spectral transmittance distribution of the antistatic selective light absorption film 1 formed over the outer surface of the face plate 4. This distribution has the main absorption peak (K) at 572 nm between the main spectrum wavelengths of the relative luminous intensities G and R. The distribution has the sub absorption peak M at 410 nm on the short wavelength side of the main spectrum wavelength of the relative luminous intensity B. In this case, it is possible to control the original color of the phosphor screen by the absorption peak wavelengths and the absorbances of the main absorption peak K and the sub absorption peak M.

In this way, the antistatic type selective light absorption film 19 sets the main peak K in the range of 570 to 610 nm, which is relatively high for the spectral luminous efficacy of human eyes and is not greatly influenced by the light emitted from the phosphor screen. Furthermore, a sub absorption peak is set in a wavelength band which exerts as little influence as possible on the light emitted from the phosphor screen so as to control the original color of the phosphor screen itself. By setting the absorption peaks in this way, it is possible to effectively absorb the external light while maintaining the brightness of the phosphor screen and the achromatic color of the phosphor screen itself, thereby improving the contrast control. It is very important to set at least two absorption peaks in order to realize an achromatic color of the phosphor screen itself, as described above.

The selection of an inorganic or organic pigment or die is very important to the optical characteristics of the antistatic type selective light absorption film 19. Two or more kinds of pigment or dye are sometimes mixed in order to produce the optical characteristics having one absorption peak, and in the case of providing a plurality of absorption peaks, the coating has a more complicated mixed form.

FIG. 19 explains the optical characteristics of an antistatic type selective light absorption film which is obtained by a similar method to that shown in FIG. 16. In FIG. 19, the curve B shows a spectrum distribution of the relative luminous intensity of blue luminescence on the phosphor screen of the color cathode ray tube, the main spectrum wavelength thereof being about 450 nm. Similarly, the curves G and R show the relative luminous intensities of the green luminescence and the red luminescence, respectively, the main spectrum wavelengths thereof being about 535 nm and 625 nm, respectively. Each of the curves (II) and (III) shows a spectral transmittance distribution of the face plate with the phosphor screen of the color cathode ray tube formed thereon. The curve (II) shows a spectral transmittance distribution of a clear type face plate 4 having a spectral transmittance of about 85% in the visible light region, while the curve (III) shows a spectral transmittance distribution of a tint type face plate having a spectral transmittance of about 50% in the visible light region.

The spectral transmittance distribution of the face plate is controlled by the amount of dye added to the glass material which constitutes the face plate. The face plates of color cathode ray tubes are produced by mass production and the glass material is melted in a very large melting furnace, so that the usable glass materials are greatly limited and it is actually difficult to obtain a face plate having a desired transmittance.

The glass of the face plate is made thicker in proportion to the size of a color cathode ray tube in order to obtain the required mechanical strength of a color cathode ray tube, which is composed of a vacuum container. Therefore, the transmittance of the face plate is different depending upon the size of a color cathode ray tube even if the same glass material is used.

Since the transmittance of the face plate is different depending upon the size of a color cathode ray tube even if the same glass material is used, when color television sets having different sizes are grouped together, the face plates have different black colors. If such a group of television sets are arranged at a shop, the different black colors of the face plates may sometimes give an unprofessional impression.

Furthermore, as the size of the color cathode ray tube becomes larger, the brightness of a color cathode ray tube becomes more difficult to obtain. Therefore, it is preferable from the point of view of brightness that the transmittance of the face plate is preferably increased as the size of a color cathode ray tube is increased. If it is possible to select the transmittance of the face plate 4 which optimizes the brightness and the contrast control, it is the most desirable with respect to the picture quality of a color television set.

If it were possible to select appropriate glass materials which were different depending upon the size of a color cathode ray tube, the above-described problems would be solved, but it is very difficult for the above-described reasons. As a countermeasure, a method of controlling the transmittance of the porous silica ($SiO_2$) film provided on the outer surface of the face plate for the purpose of antistatic treatment by adding the particles of an inorganic or organic pigment or dye to the silica film has partially come into practical use, as described above.

The curve (I) in FIG. 19 shows the spectral transmittance distribution of an antistatic type uniform light absorption film formed over the outer surface of the face plate for this purpose. It is possible to set the transmittance of the functional film at a desired value by controlling the amount of particles of inorganic or organic pigment or dye added. It is therefore possible to select the total transmittance of the phosphor screen consisting of the functional film and the face plate as desired by providing the functional film having the desired transmittance over a conventional face plate having a predetermined constant transmittance. Thus, the above-described problems can be solved.

The selection of an inorganic or organic pigment or die is also very important to the optical characteristics of the antistatic type uniform light absorption film. Two or more kinds of pigment or dye are sometimes mixed in order to produce the optical characteristics having uniform absorption in the entire visible light region.

Since the contrast control is enhanced by the use of various methods such as those described above with the recent strong demand for a high quality color television picture, the more the transmittance of the face plate is lowered, and the more the transmittance of an antistatic type selective light absorption film or an antistatic type uniform light absorption film is lowered, the more the external light tends to be reflected from the surface of the face plate. The reflection makes the image hard to see and strains the eyes of the viewer.

To solve such problems, the applicant proposed an antistatic type selective light absorption and low-reflection film and an antistatic type uniform light absorption and low-reflection film having another function in addition to those of the antistatic type selective light absorption film or the antistatic type uniform light absorption film formed over the outer surface of a face plate.

FIG. 20 is a schematic enlarged sectional view of a phosphor screen for explaining the structure of such an antistatic type selective light absorption and low-reflection film 21. An alcohol solution of silicon (Si) alkoxide including a functional group such as an —OH group and an —OR group is used as a base coating. The filler particles 18 for imparting electric conductivity and the particles 20 of an inorganic or organic pigment or dye for coloring the film 21 are added to the base coating. Furthermore, the ultrafine particles 22 of magnesium fluoride ($MgF_{22}$), having an average particle diameter of not more than 1000 A Åare dispersed in and mixed with the coating with the particles 18 and 20 added thereto in order to lower the refractive index of the coating film. The thus-obtained coating having a low refractive index is applied onto the outer surface of the face plate 4 of a color cathode ray tube by spin coating or the like to a uniform thickness, thereby forming a low-refraction layer 21. That is, the low-refraction layer 21 is composed of the conventional porous silica ($SiO_2$) film 12, and the conductive filler particles 18, the particles 20 of an inorganic or organic pigment or dye and the ultrafine particles 22 of magnesium fluoride ($MgF_2$) added thereto.

The control of the refractive index and the film thickness of the low-refraction layer 21 is important for an optical monolayer antistatic type selective light absorption and low-reflection film composed of the single low-refraction layer 21 to keep the desired low-reflection characteristic. The curve (a) in FIG. 21 shows the surface spectral reflectance of the antistatic type selective light absorption film 19. The antistatic type selective light absorption film 19 has a surface reflectivity of about 4% in the visible light region. The curve (b) shows the surface spectral reflectance of the optical monolayer antistatic type selective light absorption and low-reflection film obtained by controlling the refractive index and the film thickness of the low-refraction layer 22 to constant values. By using the low-refraction layer 22, it is possible to reduce the surface reflectivity to about 1.5%. An optical monolayer antistatic type uniform light absorption and low-reflection film can also be produced by a similar method.

FIG. 22 is a schematic enlarged sectional view of a phosphor screen for explaining another structure of the antistatic type selective light absorption and low-reflection film 21. In this case, a combination of a high-refraction layer 23 and the low-refraction layer 21 each having predetermined refractive index and film thickness constitutes an optical multilayer antistatic type selective light absorption and low-reflection film.

In the high-refraction layer 23, in addition to the conductive filler particles 18 and the particles 20 of an inorganic or organic pigment or dye dispersed in and mixed with the porous silica ($SiO_2$) film 12, the ultrafine particles 24 of a high-refraction material are added in order to raise the refractive index of the film. As the ultrafine particles 24 of a high-refraction material, particles of titanium oxide ($TiO_2$), tantalum oxide ($Ta_2O_5$), zirconium oxide ($ZrO_2$), zinc sulfide (ZnS), etc. which have an average particle diameter of not more than 1000 A Åare suitable. Since the low-refraction layer 21 has the same structure as the low-refraction layer 21 (FIG. 20) which constitutes the optical monolayer antistatic type selective light absorption and low-reflection film, explanation thereof will be omitted.

The control of the refractive index and the film thickness of each of the high-refraction layer 23 and the low-refraction layer 21 is important for the optical multilayer antistatic type selective light absorption and low-reflection film composed of a combination of the high-refraction layer 23 and the low-refraction layer 21 to keep the desired low-reflection characteristic. The curve (c) in FIG. 21 shows the surface spectral reflectance of the optical multilayer antistatic type selective light absorption and low-reflection film. By appropriately controlling the refractive index and the film thickness of each of the high-refraction layer 23 and the low-refraction layer 21, it is possible to reduce the surface reflectivity to about 1.0%.

In the case of an optical multilayer antistatic type selective light absorption and low-reflection film, the larger the number of layers is, the lower surface reflectivity is realized. However, since the fine control and the suppression of the variation of the film thickness of such a film formed by spin coating are difficult, the number of layers will be limited to two to four. An optical multilayer antistatic type uniform light absorption and low-reflection film can also be produced by a similar method.

As described above, the number of kinds and amount of material added to the porous silica ($SiO_2$) film as a base film increases with increase in the function such as antistatic function, selective light absorbing function and reflectivity lowering function. These different kinds of material are essential for adding a new function to the functional film, but many of them are inferior to silica ($SiO_2$) in the hardness and adhesion to glass. Thus, the increase in the amount of particles of different materials added to the functional film is an important problem in respect of the strength of the functional film.

As methods of evaluating the strength of the functional film formed over the outer surface of the face plate of a color cathode ray tube, a pencil hardness test and an eraser test are adopted. The pencil hardness test is a method of evaluating the hardness of a film by pressing the leads of various hardnesses against the functional film surface with a constant load so as to draw lines on the film and judge whether or not a scratch is left on the film surface. The results of the evaluation are represented by the upper limit of the hardness of the pencil which does not leave a scratch on the film For example, "5H" means that the film does not receive a scratch from a pencil having a hardness of 5H but receives a scratch from a pencil having a hardness of 6H or more. The eraser test is a method of evaluating the adhesiveness and the wear resistance of a film by the largest number of times a plastic eraser has been rubbed against the film surface with a constant load before the film receives a scratch. For example, 50 times means that the film receives no scratch from a predetermined plastic eraser which has been rubbed against the film surface not more than 50 times.

Table 1 shows the results of the evaluation of the film strengths of conventional functional films (1) to (4) formed over the outer surface of the face plate 4 of a color cathode ray tube.

TABLE 1

| | Face Plate | | Film strength of the outer surface | |
|---|---|---|---|---|
| | Outer surface (conventional functional film) | Inner surface | Pencil strength | Eraser test (times) |
| (1) | Silica ($SiO_2$) film + conductive filler (single layer) | — | 9H | 70 |
| (2) | Silica ($SiO_2$) film + conductive filler + light selective absorber (single layer) | — | 8H | 50 |
| (3) | Silica ($SiO_2$) film + conductive filler + light selective absorber + low-refraction material (single layer) | — | 5H | 20 |
| (4) | First layer [silica ($SiO_2$) film + light selective absorber + conductive filler + high-refraction material] + second layer [silica ($SiO_2$) film + light selective absorber + conductive filler + low-refraction material] (double layer) | — | 3H | 10 |

The functional film (1) is the antistatic type functional film 17 produced by dispersing and mixing the conductive filler particles 18 in with the porous silica ($SiO_2$) film 12, as shown in FIG. 15. The film strength is 9H—70 times. As to the hardness 9H, since there is no pencil having a greater hardness, the actual hardnesses of films having a hardness of 9H may be different. However, a film having a pencil hardness of not less than 9H produces no problem under the actual use conditions for a color cathode ray tube.

The functional film (2) is the antistatic type selective light absorption film 19 produced by dispersing and mixing the conductive filler particles 18 and the particles 20 of an inorganic or organic pigment or dye in with the porous silica ($SiO_2$) film 12, as shown in FIG. 16. The film strength is 8H—50 times. The film strength of the functional film 2 is lower than that of the functional film (1) because of the addition of the particles 20 of an inorganic or organic pigment or dye.

The functional film (3) is the optical monolayer antistatic type selective light absorption and low-reflection film 21 produced by dispersing and mixing the conductive filler particles 18, the particles 20 of an inorganic or organic pigment or dye, and the ultrafine particles 22 of magnesium fluoride ($MgF_2$) in with the porous silica ($SiO_2$) film 12, as shown in FIG. 20. The film strength is 5H—20 times. The film strength of the functional film (3) is considerably lower than that of the functional film (2) because of the addition the ultrafine particles 22 of magnesium fluoride ($MgF_2$).

The functional film (4) is the optical multilayer antistatic type selective light absorption and low-reflection film composed of: a high-refraction layer having a predetermined thickness which is produced by dispersing and mixing the conductive filler particles 18, the particles 20 of an inorganic or organic pigment or dye, and the ultrafine particles 24 of a high-refraction material, which are added in order to raise the refractive index of the film, in with the porous silica ($SiO_2$) film 12; and a low-refraction layer having a predetermined thickness which is produced by dispersing and mixing the conductive filler particles 18, the particles 20 of an inorganic or organic pigment or dye, and the ultrafine particles 22 of magnesium fluoride ($MgF_2$) in with the porous silica ($SiO_2$) film 12, as shown in FIG. 22. The film strength of the functional film (4) is further lowered to 3H—10 times. This is because the total film thickness increases by the thickness of the high-refraction layer 23, and the high refraction layer 23 itself is produced by adding various kinds of materials to the porous silica ($SiO_2$) film 12, thereby lowering the film strength.

Table 2 also shows the results of evaluation of the film strengths of conventional functional films (5) to (8) formed over the outer surface of the face plate 4 of a color cathode ray tube.

TABLE 2

| Face Plate | | | Film strength of the outer surface | |
|---|---|---|---|---|
| | Outer surface (conventional functional film) | Inner surface | Pencil strength | Eraser test (times) |
| (5) | Silica ($SiO_2$) film + conductive filler (single layer) | — | 9H | 70 |
| (6) | Silica ($SiO_2$) film + conductive filler + light uniform absorber (single layer) | — | 8H | 40 |
| (7) | Silica ($SiO_2$) film + conductive filler + light uniform absorber + low-refraction material (single layer) | — | 6H | 15 |
| (8) | First layer [silica ($SiO_2$) film + light uniform absorber + conductive filler + high-refraction material] + second layer [silica ($SiO_2$) film + light uniform absorber + conductive filler + low-refraction material] (double layer) | — | 4H | 5 |

The functional film (5) is the same as the functional film (1) and is listed as a comparison.

The functional film (6) is an antistatic type uniform light absorption film produced by dispersing and mixing conductive filler particles and the particles of an inorganic or organic pigment or dye in with a porous silica ($SiO_2$) film in the same way as shown in FIG. 16. The film strength is 8H—40 times. The film strength of the functional film (6) is lower than that of the functional film (5) because of the addition of the particles of an inorganic or organic pigment or dye.

The functional film (7) is an optical monolayer antistatic type uniform light absorption and low-reflection film produced by dispersing and mixing conductive filler particles, the particles of an inorganic or organic pigment or dye, and the ultrafine particles of magnesium fluoride ($MgF_2$) in with a porous silica ($SiO_2$) film in the same way as shown in FIG. 20. The film strength is 6H—15 times. The film strength of the functional film (7) is considerably lower than that of the functional film (6) because of the addition of the ultrafine particles 22 of magnesium fluoride ($MgF_2$).

The functional film (8) is an optical multilayer antistatic type uniform light absorption and low-reflection film composed of: a high-refraction layer having a predetermined thickness which is produced by dispersing and mixing conductive filler particles, the particles of an inorganic or organic pigment or dye, and the ultrafine particles of a high-refraction material, which are added in order to raise the refractive index of the film, in with a porous silica ($SiO_2$) film; and a low-refraction layer having a predetermined thickness which is produced by dispersing and mixing conductive filler particles, the particles of an inorganic or organic pigment or dye, and the ultrafine particles of magnesium fluoride ($MgF_2$) in with a porous silica ($SiO_2$) film, in the same way as shown in FIG. 22. The film strength of the functional film (8) is further lowered to 4H—5 times. This is because the total film thickness increases by the thickness of the high-refraction layer, and the high refraction layer itself is produced by adding various kinds of materials to the porous silica ($SiO_2$) film, thereby lowering the film strength.

As described above, in a conventional color cathode ray tube, as more functions such as an antistatic function, selective light absorbing function and low-reflection function are added to the functional film formed over the outer surface of the face plate, the number of kinds and amount of material added to the porous silica ($SiO_2$) film as a base film increases, so that the film strength is greatly lowered. This leads to various problems such as scratches on the functional film formed over the outer surface of the face plate and the peeling-off of the functional film, which not only impair the external appearance but also influence the definition of the image.

SUMMARY OF THE INVENTION

Accordingly, it is an object of the present invention to eliminate the above-described problems in the related art and to provide a color cathode ray tube provided with a functional film having an improved mechanical strength without lessening the antistatic, selective light absorbing, uniform light absorbing and reflectivity lowering effects of the cathode ray tube as a whole.

To achieve this aim, the present invention provides a color cathode ray tube comprising:

(a) a face plate towards the inner surface of which electron beams are projected;

(b) a transparent functional film formed over the outer surface of the face plate;

(c) a tricolor phosphor layer including red, green and blue phosphors which emit light when the electron beams are impinged thereon, and provided on the inner surface of the face plate; and (d) an intermediate layer having predetermined optical characteristics and provided between the inner surface and the tricolor phosphor layer of the face plate.

According to this structure, among the various functions of the conventional functional film, the function relating to the control of the optical characteristics is transferred to the intermediate layer. It is therefore unnecessary to add fine particles or the like to the functional film which are conventionally necessary in order to control the optical characteristics. In other words, it is possible to avoid, to a certain extent, the mixture of foreign matter, which lowers the mechanical strength of the functional film and to enhance the mechanical strength of the functional film. It is therefore possible to realize a functional film which is harder to scratch and peel off than a conventional functional film and, hence, which does not impair the definition of the picture. Furthermore, the stability to the heat treatment at 400° to 500° C. in the production process or inspection process and the stability to an electron beam and X-rays are also enhanced.

The intermediate layer may be either a selective light absorption layer having a light absorbing characteristic common to blue, green and red phosphors or a neutral filter layer having a uniform transmittance with respect to blue, green and red phosphors.

In the case of using a selective light absorption layer as the intermediate layer, the light absorbing characteristic thereof preferably has at least two peaks. If three peaks are set, for example, a first peak is set at a wavelength between the peak of the relative luminous intensity spectrum of the red phosphor and the peak of the relative luminous intensity spectrum of the green phosphor, a second peak is set at a wavelength between the peak of the relative luminous intensity spectrum of the green phosphor and the peak of the relative luminous intensity spectrum of the blue phosphor, and the third peak is set at a wavelength lower than the peak of the relative luminous intensity spectrum of the blue phosphor.

If two peaks are set, for example, a first peak is set at a wavelength between the peak of the relative luminous intensity spectrum of the red phosphor and the peak of the relative luminous intensity spectrum of the green phosphor, and the second peak is set at a wavelength lower than the luminous intensity spectrum of the blue phosphor.

In such settings, the first peak is set as the main absorption peak having a relatively lower transmittance than the other peak or any of the other peaks, and the other one or two peaks are set as sub absorption peak(s).

In order to form an intermediate layer such as a selective light absorption layer and a neutral filter layer, a method of, for example, dispersing and mixing coloring particles in with a binder so as to produce a coating liquid and applying the coating liquid to the inner surface of a face plate is adopted. As the coloring particles, the particles of inorganic pigment, inorganic dye, organic pigment or organic dye are used. At least two kinds of coloring particles are preferably used. The average particle diameter of the coloring particles is preferably not more than 1.0 μm. Graphite particles and carbon particles are suitable as the coloring particles.

As examples of the functional film, an antistatic film or a low-reflection film will be cited. If an antistatic film is used as the functional film, this film releases the charges produced on the outer surface of the face plate. The antistatic film is produced from, for example, a transparent $SiO_2$ film with fine conductive particles dispersed and mixed therein and therewith, or a transparent $SiO_2$ film containing water. In the former structure, the fine particles of either $SnO_2$ or $In_2O_3$ are preferably used. In the latter structure, the water may be either the water contained in the porous transparent $SiO_2$ film or water absorbed from the air.

If a low-reflection film is used as the functional film, it is produced by, for example, applying a low-refraction base coating to the outer surface of the face plate. The film thickness is made constant by spin coating.

In the case of using a low-reflection film as the functional film, a high-reflection film may further be used. The high-reflection film is produced by applying a high-refraction base coating to the outer surface of the face plate. The high-reflection film and the low-reflection film are alternately laminated. In this case, the total number of films is preferably two to four.

If conductivity is imparted to the low-reflection film, it is possible to impart an antistatic function to the functional film. To produce such a film, fine conductive particles are added to the low-reflection film. As the fine particles, fine particles of $SnO_2$ or $In_2O_3$ are used.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiments of the present invention will be explained with reference to the accompanying drawings.

First Embodiment

Figure 1:
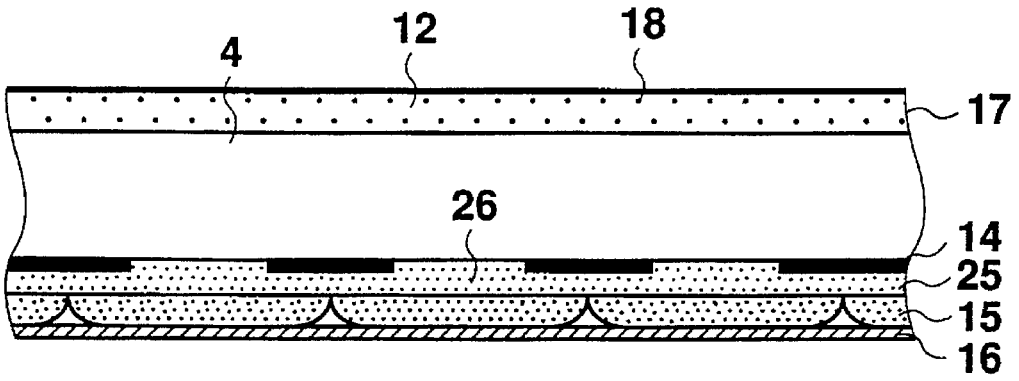
FIG. 1 is a schematic enlarged sectional view of the structure of a phosphor screen having an antistatic type selective light absorption film as a first embodiment of the present invention.

FIG. 1 is a schematic enlarged sectional view of the structure of a phosphor screen according to the present invention, which has antistatic and selective light absorbing functions similar to those of a conventional antistatic type selective light absorption film. The antistatic type selective light absorption film 17 produced by dispersing and mixing the conductive filler particles 18 in with the porous silica ($SiO_2$) film 12 is formed over the outer surface of the face plate 4. On the inner surface of the face plate 4 are formed the black light absorbing layer 14, the BGR phosphor layer 15 and the metal-backed layer 16 in the same way as in a conventional phosphor screen. The present invention is different from a conventional phosphor screen in that a selective light absorption layer 25 having optical characteristics common to the three colors B, G and R is provided between the inner surface of the face plate 4 and the BGR phosphor layer 15 provided on the inner surface of the face plate 4.

Figure 17:
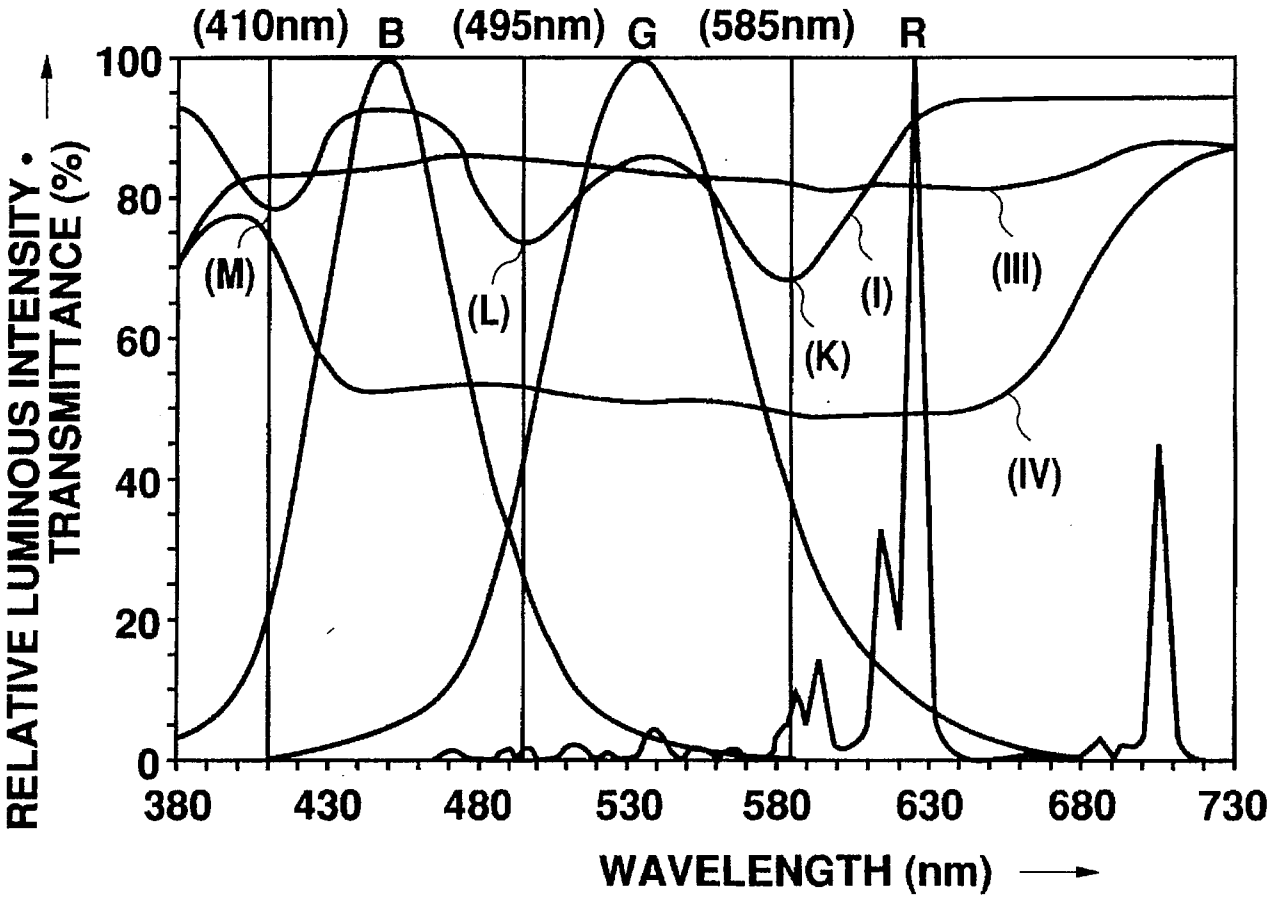
Fig. 17 PRIOR ART
FIG. 17 shows an example of the optical characteristics of the antistatic type selective light absorption film of the third conventional example.
Figure 18:
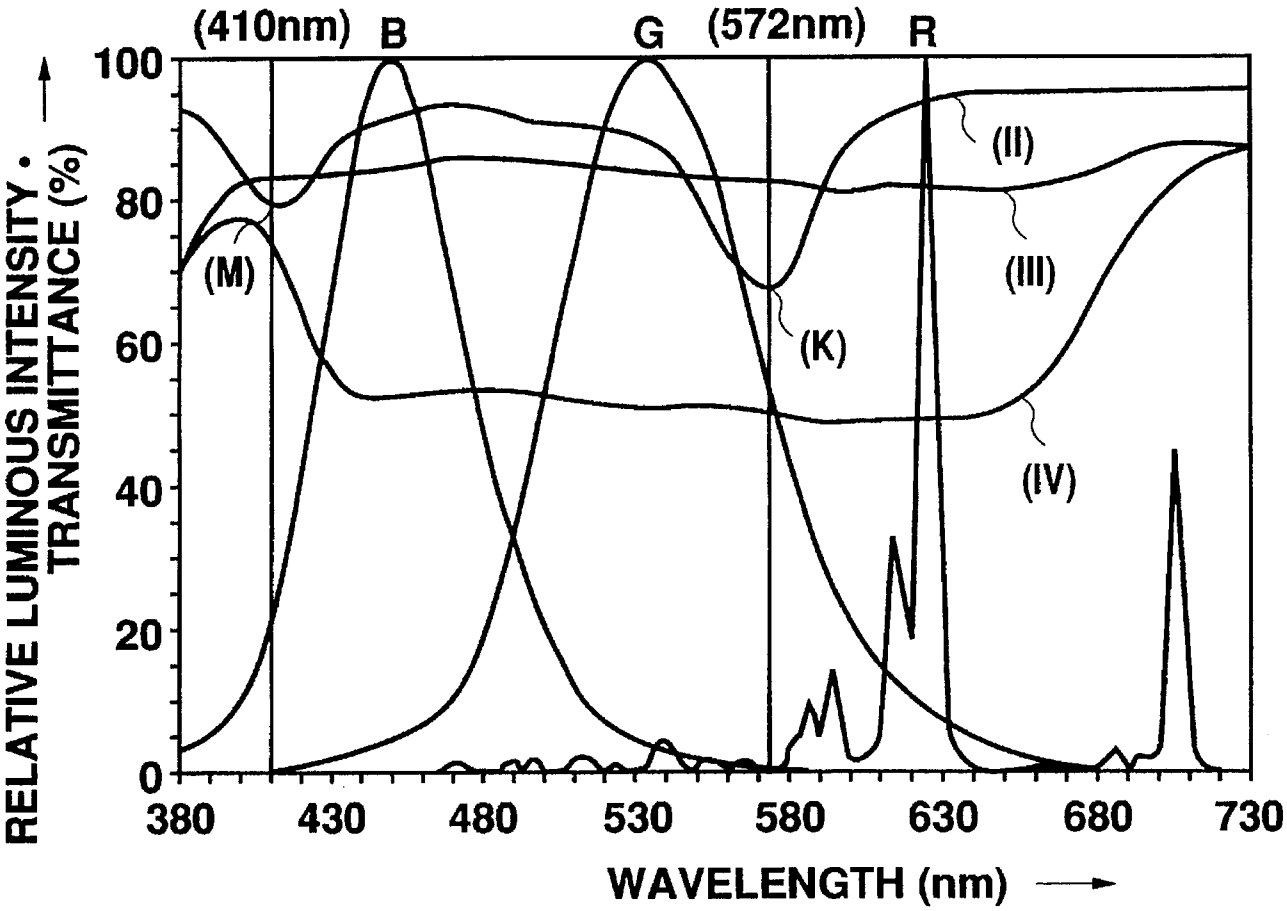
Fig. 18 PRIOR ART
FIG. 18 shows another example of the optical characteristics of the antistatic type selective light absorption film of the third conventional example.
Figure 19:
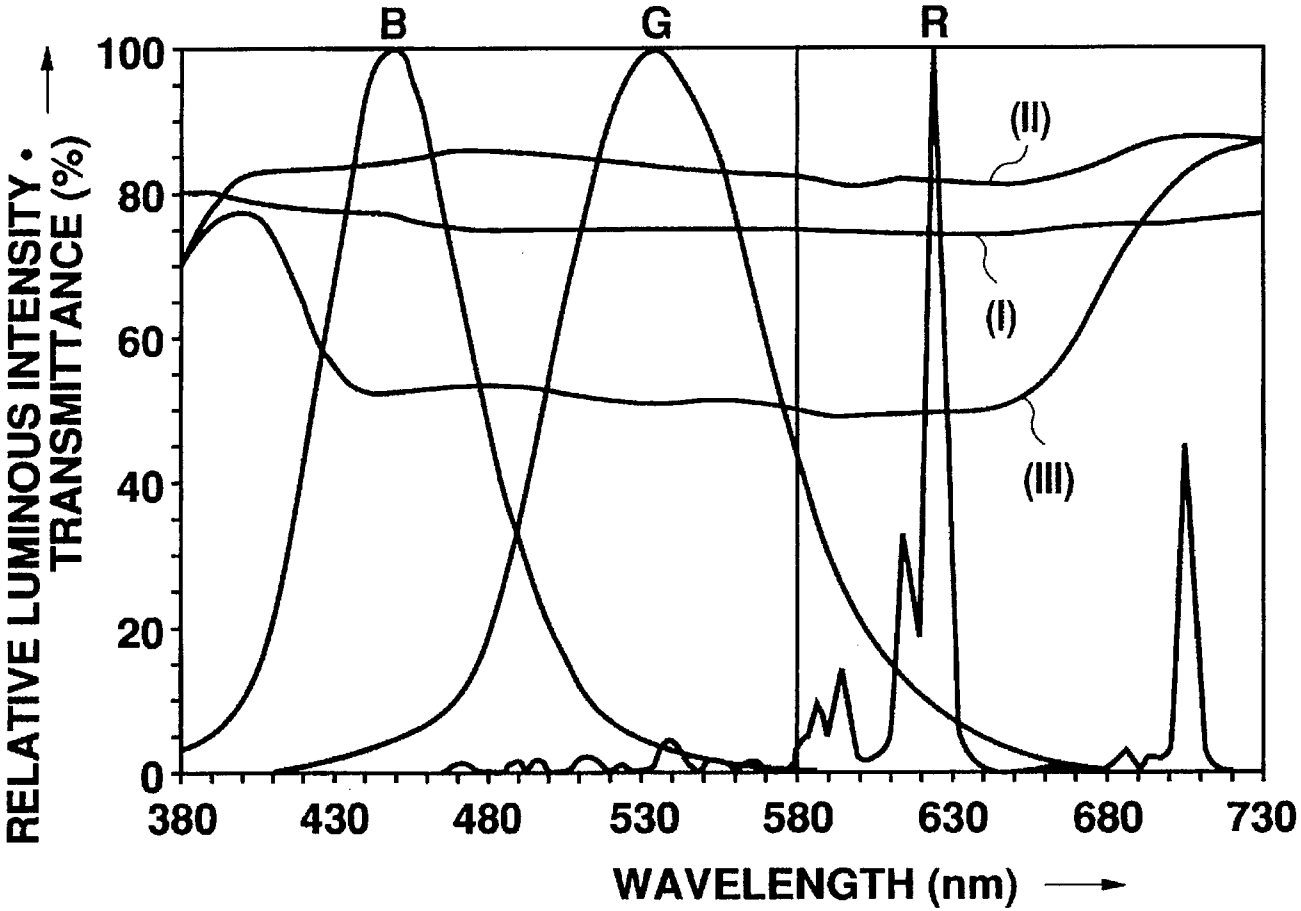
Fig. 19 PRIOR ART
FIG. 19 shows an example of the optical characteristics of the antistatic type uniform light absorption film of the third conventional example.
Figure 21:
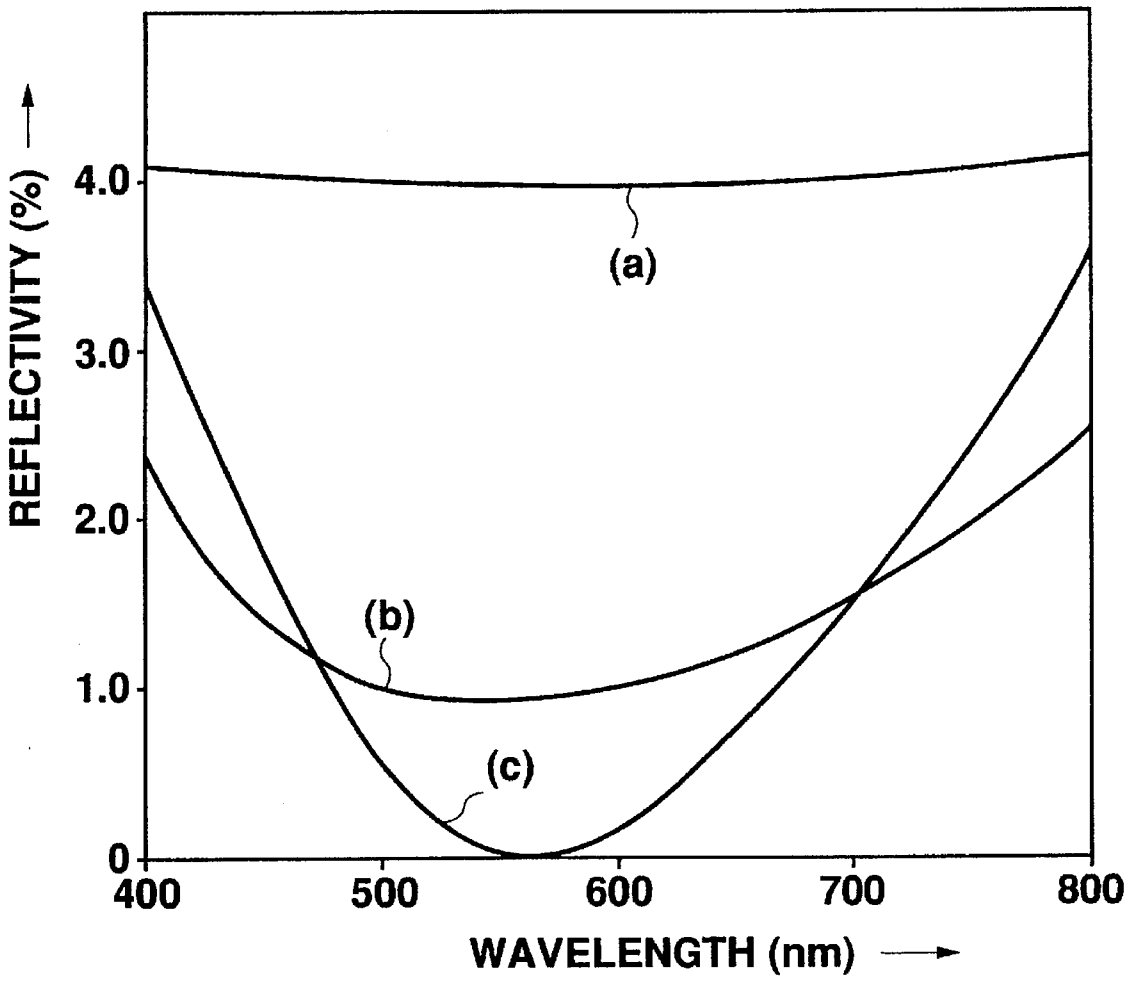
Fig. 21 PRIOR ART
FIG. 21 shows the optical characteristics of conventional examples, wherein the curves (a), (b) and (c) show the surface spectral reflectances of the third conventional example, the fourth conventional example and a fifth conventional example, respectively.

As the selective light absorption layer 25, a selective light absorption layer having a light absorption characteristic with one main absorption peak and two sub absorption peaks as shown by the spectral transmittance distribution (I) in FIG. 17, a selective light absorption layer having a light absorption characteristic with one main absorption peak and one sub absorption peak as shown by the spectral transmittance distribution (II) in FIG. 18, or the like is selected with due consideration for the light emission characteristics of the BGR phosphor layer 15 and the like.

in order to form the selective light absorption layer 25, after the black light absorbing layer 14 is formed over the inner surface of the face plate 4 by a photo-engraving process as in the related art, a coating liquid obtained by dispersing and mixing the particles 26 of an inorganic or organic pigment or dye in with a binder is applied to the black light absorbing layer 14. It has been confirmed from experiments that the selective light absorption layer 25 needs to have a thickness of not less than 0.1 μm in order enhance the contrast. If the thickness is less 0.1 μm, the contrast enhancing effect is greatly diminished. This is considered to be because if the thickness is reduced, the external light absorbing action changes from volume absorption to area absorption.

Since it is difficult to obtain the desired optical characteristics described above by adding only one kind of particle 26 of an inorganic or organic pigment or dye to the binder, a mixture of two to four kinds of inorganic or organic pigment or dye is used. In order to form the selective light absorption layer 25 of a uniform film, the average particle diameter of the particles 26 of inorganic or organic pigment or dye added to the binder is preferably not more than 1.0 μm.

After forming the selective light absorption layer 25 over the inner surface of the face plate 4, the BGR phosphor layer 15 and the metal-backed layer 16 are formed on the selective light absorption layer 25 by the same method as in the related art. As a result, the optical characteristics of the selective light absorption layer 25 are common to the light emitted from the BGR phosphor layer 15.

The functional film (9) in Table 3 is the functional film formed over the outer surface of the face plate 4 in this embodiment. The measured film strength was 9H—70 times. Since the antistatic function and the selective light absorbing function of the phosphor screen as a whole are equivalent to those of the conventional functional film (2) shown in Table 1, the film strength of the functional film (9) is greatly improved in comparison with the film strength 8H—50 times of the functional film (2).

TABLE 3

| | Face Plate | | Film strength of the outer surface | |
|---|---|---|---|---|
| | Outer surface (embodiment) | Inner surface | Pencil strength | Eraser test (times) |
| (9) | Silica ($SiO_2$) film + conductive filler (single layer) | Selective light absorbing layer | 9H | 70 |
| (10) | Silica ($SiO_2$) film + conductive filler + low-refraction material (single layer) | Selective light absorbing layer | 8H | 50 |
| (11) | First layer (silica ($SiO_2$) film + conductive filler + high-refractio material) + second layer (silica ($SiO_2$) film | Selective light absorbing layer | 7H | 40 |

TABLE 3-continued

| Face Plate | | Film strength of the outer surface | |
|---|---|---|---|
| Outer surface (embodiment) | Inner surface | Pencil strength | Eraser test (times) |
| + conductive-filler + low-refraction material) (double layer) | | | |
| (12) Silica ($SiO_2$) film + conductive filler (single layer) | Neutral filter layer | 9H | 70 |
| (13) Silica ($SiO_2$) film + conductive filler + low-refraction material (single layer) | Neutral filter layer | 8H | 40 |
| (14) First layer (silica ($SiO_2$) film + conductive filler + high-refraction material) + second layer (silica ($SiO_2$) film + conductive filler low-refraction material) (double layer) | Neutral filter layer | 7H | 30 |

Second Embodiment

Figure 2:
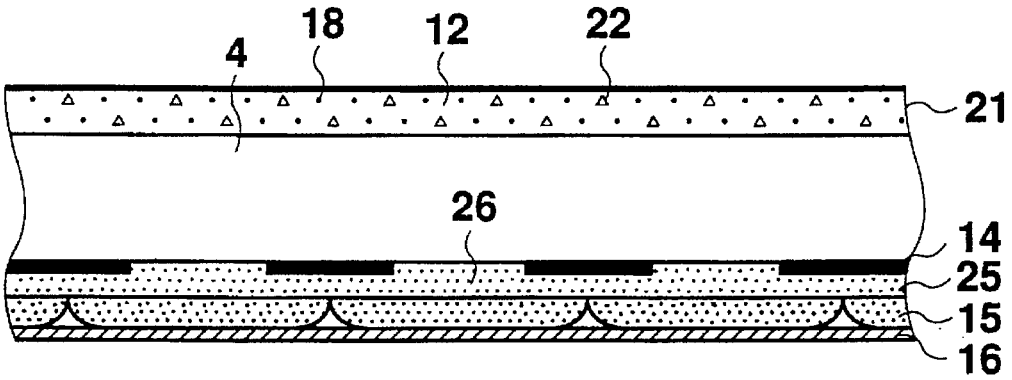
FIG. 2 is a schematic enlarged sectional view of the structure of a phosphor screen having a monolayer antistatic type selective light absorption and low-reflection film as a second embodiment of the present invention.

FIG. 2 is a schematic enlarged sectional view of the structure of a phosphor screen according to the present invention, which has an antistatic, selective light absorbing and reflectivity lowering functions similar to those of a conventional optical monolayer antistatic type selective light absorption and low-reflection film. The low-refraction layer 21 having a constant refractive index and film thickness which is produced by dispersing and mixing the conductive filler particles 18 for imparting an antistatic function and the ultrafine particles 22 of magnesium fluoride ($MgF_2$) for lowering the refractive index in with the porous silica ($SiO_2$) film 12 is formed over the outer surface of the face plate 4. The low-refraction layer 21 functions as an antistatic type low-reflection film. On the inner surface of the face plate 4, the selective light absorption layer 25 having optical characteristics common to the three colors B, G and R is provided between the inner surface of the face plate 4 and the BGR phosphor layer 15 provided on the inner surface of the face plate 4 in the same way as in the first embodiment.

The optical characteristics of the selective light absorption layer 25 and the method of producing it are exactly the same as in the first embodiment. In the phosphor screen of the second embodiment, an antistatic function and an optical monolayer low-refraction function are imparted to the outer surface of the face plate 4 while a selective light absorbing function is imparted to the inner surface of the face plate. In this way, the phosphor screen as a whole has functions similar to those of a conventional optical monolayer antistatic type selective light absorption and low-reflection film.

The functional film (10) in Table 3 is the functional film formed over the outer surface of the face plate 4 in this embodiment. The measured film strength was 8H—50 times. Since the functions of the phosphor screen as a whole are equivalent to those of the conventional optical monolayer antistatic type selective light absorption and low-reflection film (3) shown in Table 1, the film strength of the functional film (10) is greatly improved in comparison with the film strength of 5H—20 times of the functional film (3). Since the film strength expressed by a pencil hardness of 7H and an eraser test of not less than 30 times produces almost no problem from the point of view of home use of a color television set, it can be said that the functional film in the second embodiment has a sufficient mechanical strength for practical use.

Third Embodiment

Figure 3:
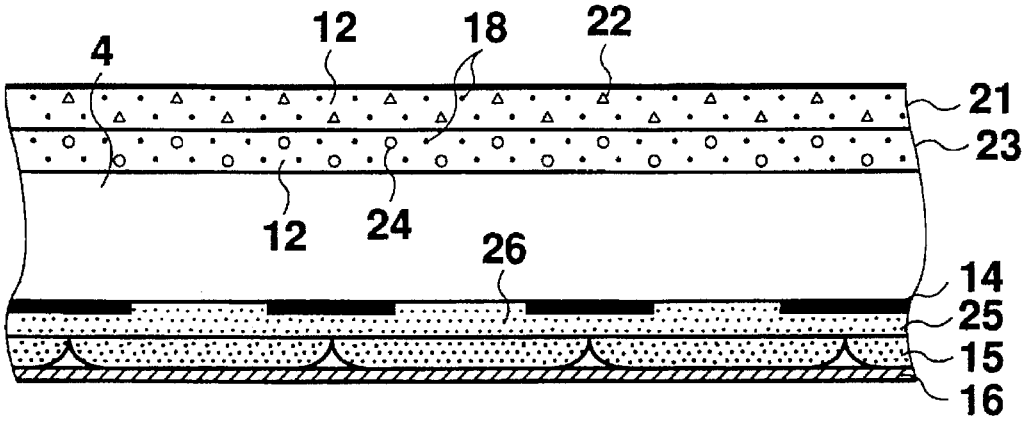
FIG. 3 is a schematic enlarged sectional view of the structure of a phosphor screen having a multilayer antistatic type selective light absorption and low-reflection film as a third embodiment of the present invention.

FIG. 3 is a schematic enlarged sectional view of the structure of a phosphor screen according to the present invention, which has functions similar to those of a conventional optical multilayer antistatic type selective light absorption and low-reflection film. An optical multilayer antistatic type low-reflection film which is composed of the high-refraction layer 23 and the low-refraction layer 21 each having constant refractive index and film thickness is formed over the outer surface of the face plate 4.

The high-refraction layer 23 is produced by dispersing and mixing the conductive filler particles 18 and the ultrafine particles 24 of a high-refraction material for raising the refractive index in with the porous silica ($SiO_2$) film 12 so as to have a constant refractive index and film thickness. As the ultrafine particles 24 of a high-refraction material, the particles of titanium oxide ($TiO_2$) , tantalum oxide ($Ta_2O_5$) , zirconium oxide ($ZrO_2$) , zinc sulfide (ZnS), or the like which have an average particle diameter of not more than 1000 Åare used in the same way as in the related art. Since the low-refraction layer 21 has the same structure as the low-refraction layer 21 in the second embodiment, which constitutes the antistatic type low-reflection film, explanation thereof will be omitted.

On the inner surface of the face plate 4, the selective light absorption layer 25 having optical characteristics common to the three colors B, G and R is provided between the inner surface of the face plate 4 and the BGR phosphor layer 15 provided on the inner surface of the face plate 4 in the same way as in the first and second embodiments. The optical characteristics of the selective light absorption layer 25 and the method of producing it are exactly the same as in the first and second embodiments. In the phosphor screen of the third embodiment, an antistatic function and an optical multilayer low-refraction function are imparted to the outer surface of the face plate 4 while a selective light absorbing function is imparted to the inner surface of the face plate. In this way, the phosphor screen as a whole has functions similar to those of a conventional optical multilayer antistatic type selective light absorption and low-reflection film. In the case of the optical multilayer low-reflection film which is composed of a combination of the high and low-refraction layers, the larger the number of layers is, the lower the surface reflectivity which is obtained as in a conventional one. However, since the fine control and the suppression of the variation of the film thickness of such a film formed by spin coating are difficult, the number of layers will be limited to between two and four.

The functional film (11) in Table 3 is the functional film formed over the outer surface of the face plate 4 in this embodiment. The measured film strength was 7H—40 times. Since the functions of the phosphor screen as a whole are equivalent to those of the conventional optical multilayer antistatic type selective light absorption and low-reflection film (4) shown in Table 1, the film strength of the functional film (11) is greatly improved in comparison with the film strength of 3H—10 times of the functional film (4). Since the film strength of 7H—30 times produces almost no problem from the point of view of home use of a color television set, as described above, it can be said that the functional film in the third embodiment has a sufficient mechanical strength for practical use.

Figure 4:
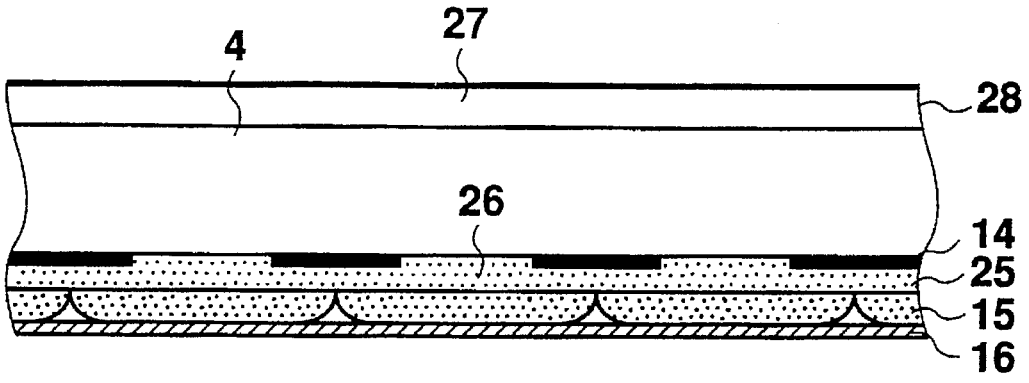
FIG. 4 is a schematic enlarged sectional view of the structure of a phosphor screen having an antistatic type selective light absorption film as a fourth embodiment of the present invention.
Figure 5:
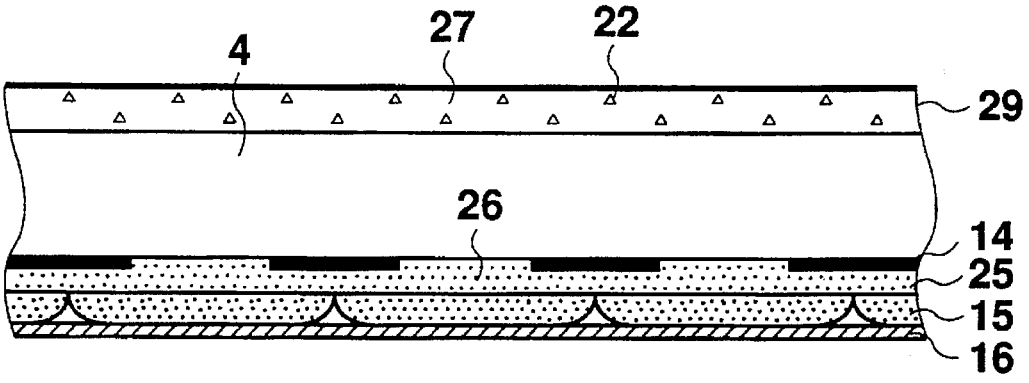
FIG. 5 is a schematic enlarged sectional view of the structure of a phosphor screen having a monolayer antistatic type selective light absorption and low-reflection film as a fifth embodiment of the present invention.
Figure 6:
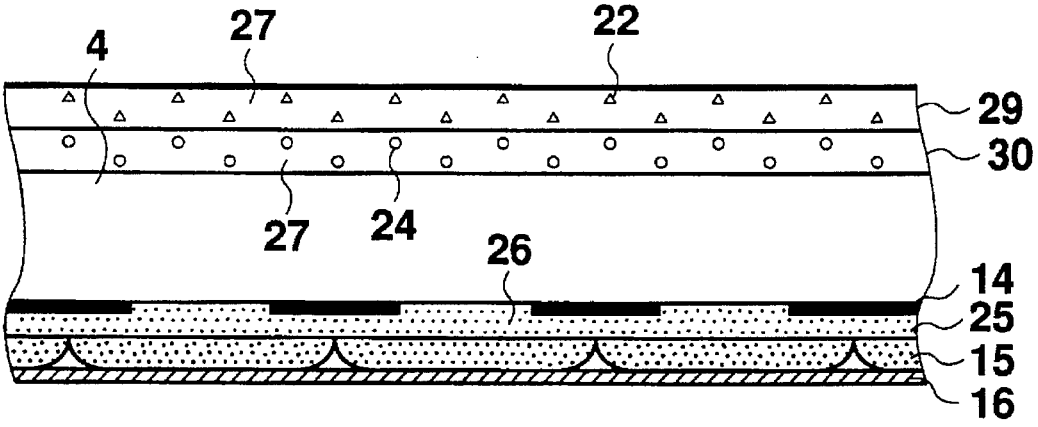
FIG. 6 is a schematic enlarged sectional view of the structure of a phosphor screen having a multilayer antistatic type selective light absorption and low-reflection film as a sixth embodiment of the present invention.

Although an antistatic function is imparted to the functional films in the first to third embodiments by dispersing and mixing the conductive filler particles 18 in with the porous silica ($SiO_2$) film 12, the present invention is not restricted thereto. It is possible to form function films 28 to 30 having conductivity by using a porous silica film 27 containing water as a base and without adding the conductive filler particles 18 thereto as in the fourth to sixth embodiments shown in FIGS. 4 to 6, respectively. The porous silica film 27 containing water is produced by taking in the water content in the porous silica ($SiO_2$) film 12 and in the air.

Seventh Embodiment

Figure 7:
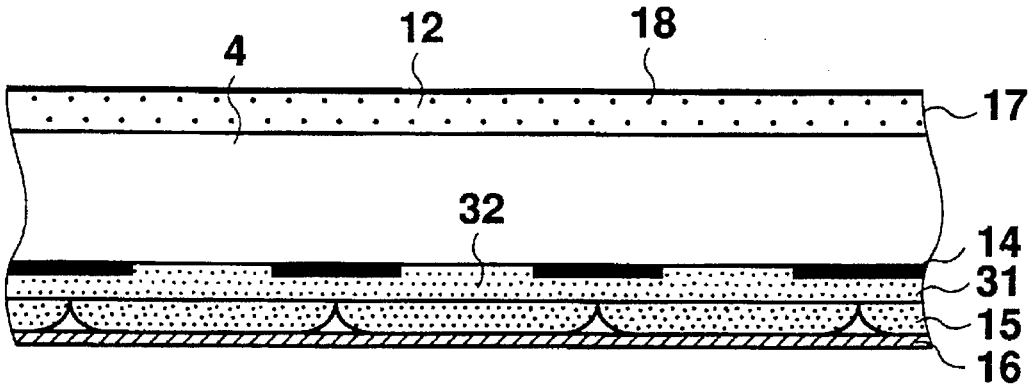
FIG. 7 is a schematic enlarged sectional view of the structure of a phosphor screen having an antistatic type uniform light absorption film as a seventh embodiment of the present invention.

FIG. 7 is a schematic enlarged sectional view of the structure of a phosphor screen according to the present invention, which has functions similar to those of a conventional antistatic type uniform light absorption film. This embodiment is different from a conventional phosphor screen in that a neutral filter layer 31 for uniformly controlling the transmittance of the light emitted from the BGR phosphor layer 15 is provided between the inner surface of the face plate 4 and the BGR phosphor layer 15 provided on the inner surface of the face plate 4.

The materials for the neutral filter layer 31 are selected so as to have a uniform spectral transmittance in the visible light region similar to the spectral transmittance distribution (I) in FIG. 17.

In order to form the neutral filter layer 31, after the black light absorbing layer 14 is formed on the inner surface of the face plate 4 by a photo-engraving process as in the related art, a coating liquid obtained by dispersing and mixing the particles 32 of an inorganic or organic pigment or dye in with a binder is applied to the black light absorbing layer 14. It has been confirmed from experiments that the neutral filter layer 25 needs to have a thickness of not less than 0.1 μm in order to enhance the contrast. If the thickness is less than 0.1 μm, the contrast enhancing effect is greatly diminished. This is considered to be because if the thickness is reduced, the external light absorbing action changes from volume absorption to area absorption.

Since it is difficult to obtain the desired optical characteristics described above by adding only one kind of particle 32 of an inorganic or organic pigment or dye to the binder, a mixture of two to four kinds of inorganic or organic pigment or dye is used. In order to form the neutral layer 31 of a uniform film, the average particle diameter of the particles 32 of inorganic or organic pigment or dye added to the binder is preferably not more than 1.0 μm.

After forming the neutral filter layer 31 over the inner surface of the face plate 4, the BGR phosphor layer 15 and the metal-backed layer 16 are formed on the neutral filter layer 31 by the same method as in the related art. As a result, the neutral filter layer 21 uniformly controls the transmittance of the light emitted from the BGR phosphor layer 15.

The functional film (12) in Table 3 is the functional film formed over the outer surface of the face plate 4 in this embodiment. The measured film strength was 9H—70 times. Since the functions of the phosphor screen as a whole are equivalent to those of the conventional functional film (6) shown in Table 2, the film strength of the functional film (12) is greatly improved in comparison with the film strength of 8H—40 times of the functional film (6).

Eight Embodiment

Figure 8:
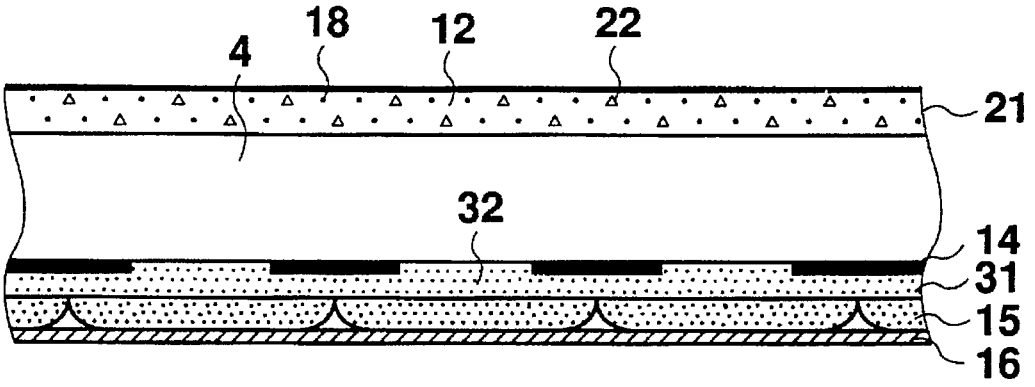
FIG. 8 is a schematic enlarged sectional view of the structure of a phosphor screen having a monolayer antistatic type uniform light absorption and low-reflection film as an eighth second embodiment of the present invention.

FIG. 8 is a schematic enlarged sectional view of the structure of a phosphor screen according to the present invention, which has antistatic, uniform light absorbing and reflectivity lowering functions similar to those of a conventional optical monolayer antistatic type uniform light absorption and low-reflection film. The low-refraction layer 21 having constant refractive index and film thickness which is produced by dispersing and mixing the conductive filler particles 18 for imparting an antistatic function and the ultrafine particles 22 of magnesium fluoride ($MgF_2$) for lowering the refractive index in with the porous silica ($SiO_2$) film 12 is formed over the outer surface of the face plate 4. The low-refraction layer 21 functions as an antistatic type low-reflection film. On the inner surface of the face plate 4, the neutral filter layer 31 for uniformly controlling the transmittance of the light emitted from the BGR phosphor layer is provided between the inner surface of the face plate 4 and the BGR phosphor layer 15 provided on the inner surface of the face plate 4 in the same way as in the seventh embodiment.

The optical characteristics of the neutral filter layer 31 and the method of producing it are exactly the same as in the seventh embodiment. In the phosphor screen of the eighth embodiment, an antistatic function and an optical monolayer low-refraction function are imparted to the outer surface of the face plate 4 while a uniform light absorbing function is imparted to the inner surface of the face plate. In this way, the phosphor screen as a whole has functions similar to those of a conventional optical monolayer antistatic type uniform light absorption and low-reflection film.

The functional film (13) in Table 3 is the functional film formed over the outer surface of the face plate 4 in this embodiment. The measured film strength was 8H—50 times. Since the functions of the phosphor screen as a whole are equivalent to those of the conventional optical monolayer antistatic type uniform light absorption and low-reflection film (7) shown in Table 2, the film strength of the functional film (13) is greatly improved in comparison with the film strength of 6H—15 times of the functional film (7). Since the film strength expressed by a pencil hardness of 7H and an eraser test of not less than 30 times produces almost no problem from the point of view of home use of a color television set, it can be said that the functional film in the second embodiment has a sufficient mechanical strength for practical use.

Ninth Embodiment

Figure 9:
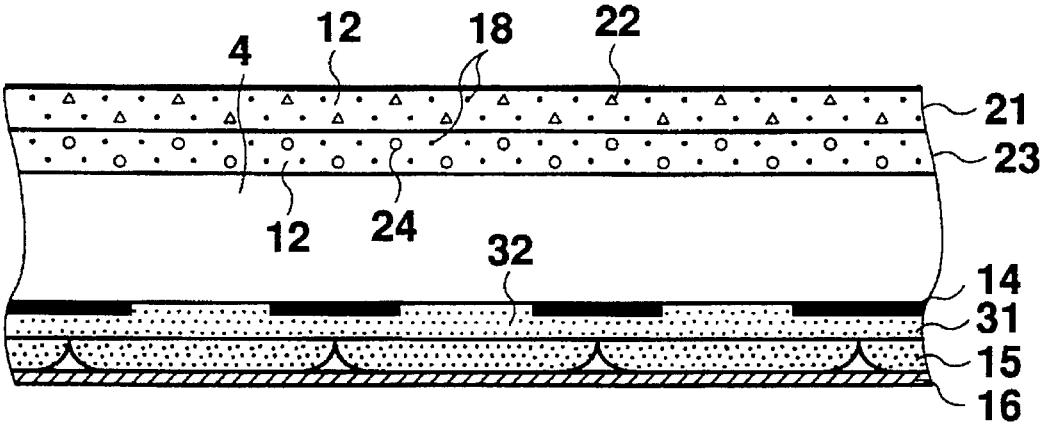
FIG. 9 is a schematic enlarged sectional view of the structure of a phosphor screen having a multilayer antistatic type uniform light absorption and low-reflection film as a ninth embodiment of the present invention.

FIG. 9 is a schematic enlarged sectional view of the structure of a phosphor screen according to the present invention, which has functions similar to those of a conventional optical multilayer antistatic type uniform light absorption and low-reflection film. An optical multilayer antistatic type low-reflection film which is composed of the high-refraction layer 23 and the low-refraction layer 21 each having constant refractive index and film thickness is formed over the outer surface of the face plate 4.

The high-refraction layer 23 is produced by dispersing and mixing the conductive filler particles 18 and the ultrafine particles 24 of a high-refraction material for raising the refractive index in with the porous silica ($SiO_2$) film 12 so as to have constant refractive index and film thickness. As the ultrafine particles 24 of a high-refraction material, the particles of titanium oxide ($TiO_2$), tantalum oxide ($Ta_2O_5$), zirconium oxide ($ZrO_2$), zinc sulfide (ZnS), or the like which have an average particle diameter of not more than 1000 Åare used in the same way as in the related art. Since the low-refraction layer 21 has the same structure as the low-refraction layer 21 in the eighth embodiment, which constitutes the antistatic type low-reflection film, explanation thereof will be omitted.

On the inner surface of the face plate 4, the neutral filter layer 31 for uniformly controlling the transmittance of the light emitted from the BGR phosphor layer 15 is provided between the inner surface of the face plate 4 and the BGR phosphor layer 15 provided on the inner surface of the face plate 4 in the same way as in the seventh and eighth embodiments. The optical characteristics of the neutral filter layer 31 and the method of producing it are exactly the same as in the seventh and eighth embodiments. In the phosphor screen of the ninth embodiment, an antistatic function and an optical multilayer low-refraction function are imparted to the outer surface of the face plate 4 while a uniform light absorbing function is imparted to the inner surface of the face plate. In this way, the phosphor screen as a whole has functions similar to those of a conventional optical multilayer antistatic type selective light absorption and low-reflection film. In the case of the optical multilayer low-reflection film which is composed of a combination of high and low-refraction layers, the larger the number of layer is, the lower the surface reflectivity which is obtained in the same way as in a conventional one. However, since the fine control and the suppression of the variation of the film thickness of such a film formed by spin coating are difficult, the number of layers will be limited to between two and four.

The functional film (14) in Table 3 is the functional film formed over the outer surface of the face plate 4 in this embodiment. The measured film strength was 7H—30 times. Since the functions of the phosphor screen as a whole are equivalent to those of the conventional optical multilayer antistatic type uniform light absorption and low-reflection film (8) shown in Table 2, the film strength of the functional film (141) is greatly improved in comparison with the film strength of 4H—5 times of the functional film (8). Since the film strength of 7H—30 times produces almost no problem from the point of view of home use of a color television set, as described above, it can be said that the functional film in the third embodiment has a sufficient mechanical strength for practical use.

Figure 10:
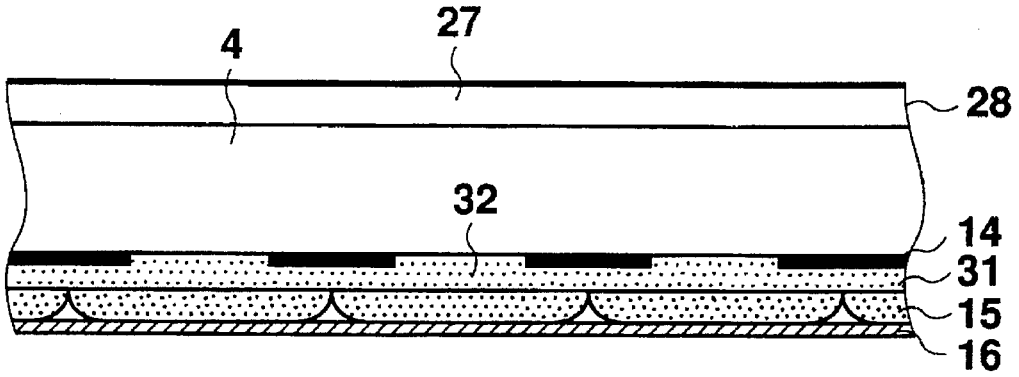
FIG. 10 is a schematic enlarged sectional view of the structure of a phosphor screen having an antistatic type uniform light absorption film as a tenth embodiment of the present invention.
Figure 11:
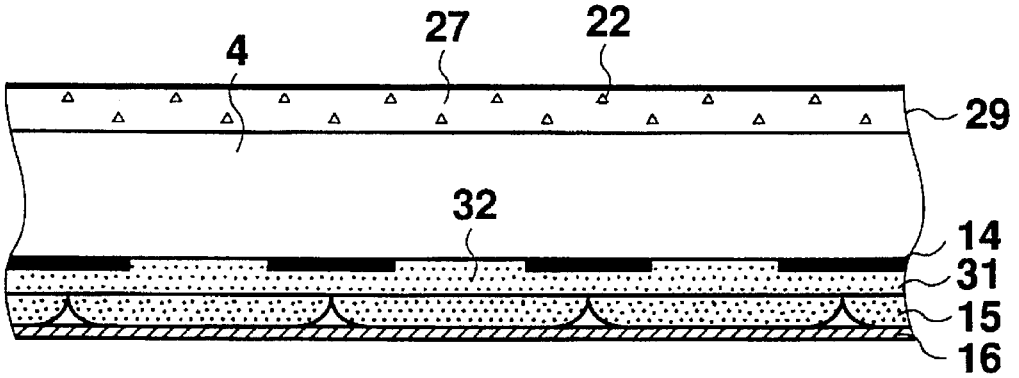
FIG. 11 is a schematic enlarged sectional view of the structure of a phosphor screen having a monolayer antistatic type uniform light absorption and low-reflection film as an eleventh embodiment of the present invention.
Figure 12:
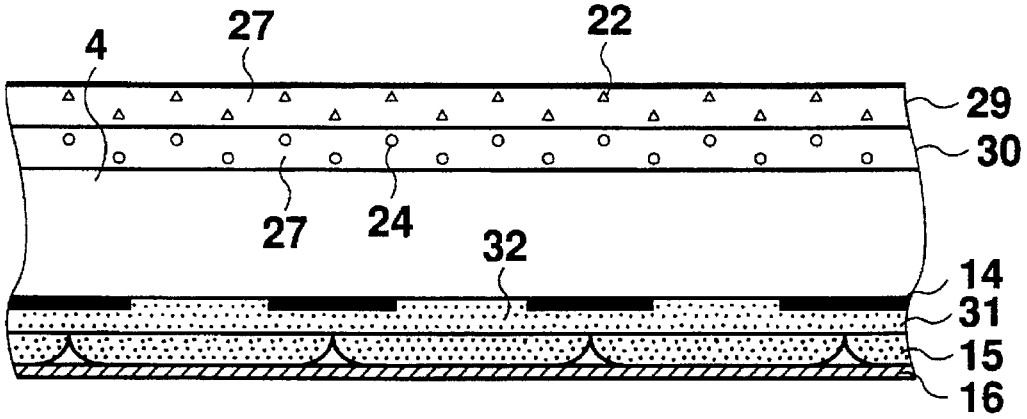
FIG. 12 is a schematic enlarged sectional view of the structure of a phosphor screen having a multilayer antistatic type uniform light absorption and low-reflection film as a twelfth embodiment of the present invention.
Figure 13:
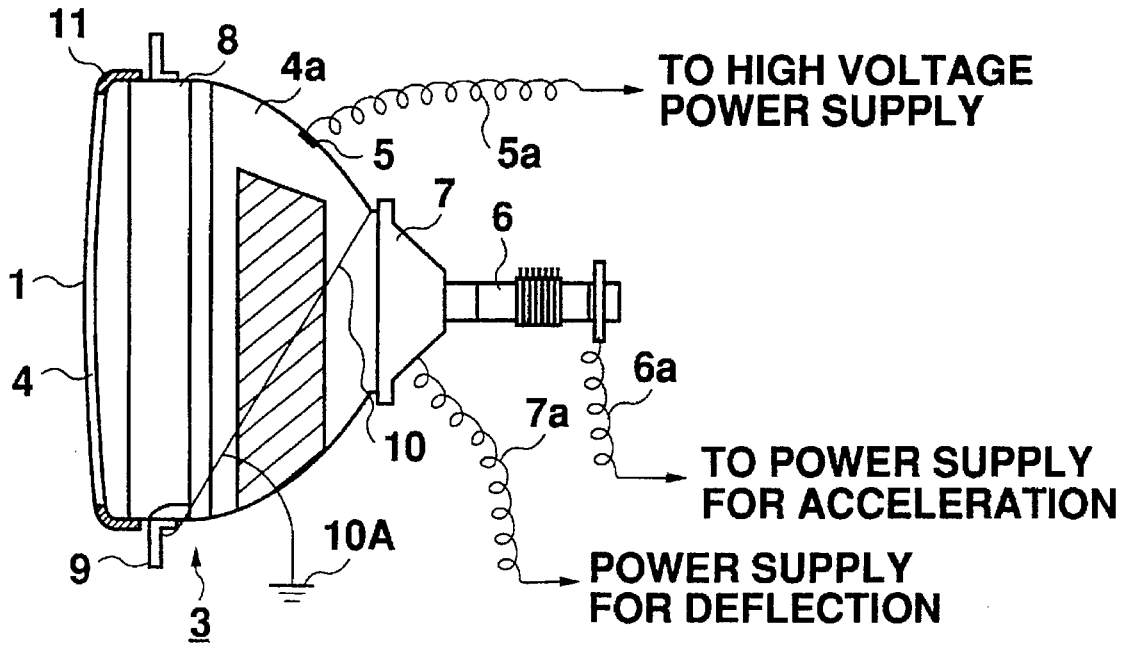
Fig. 13 PRIOR ART
FIG. 13 is a side elevational view of the general structure of a phosphor screen having an antistatic type color cathode ray tube.
Figure 14:
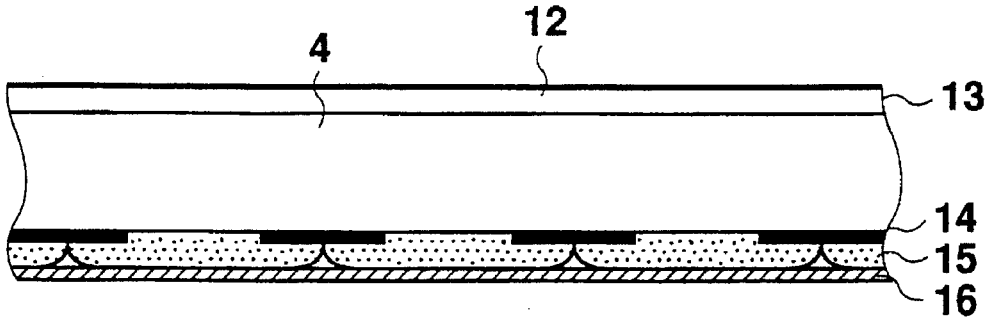
Fig. 14 PRIOR ART
FIG. 14 is a schematic enlarged sectional view of the structure of a phosphor screen having an antistatic type selective light absorption film as a first conventional example.
Figure 15:
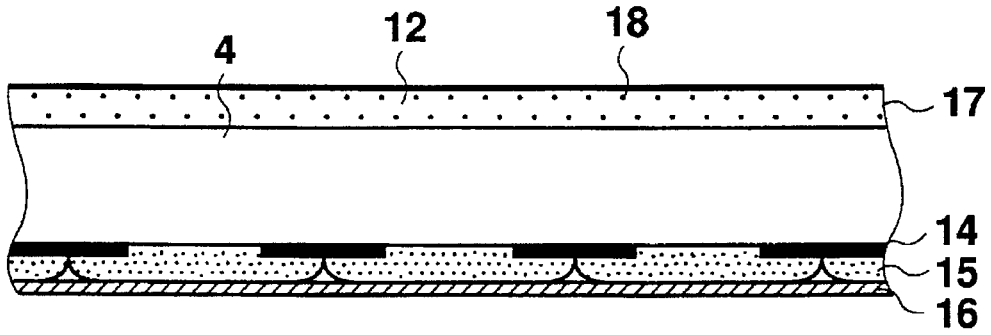
Fig. 15 PRIOR ART
FIG. 15 is a schematic enlarged sectional view of the structure of a phosphor screen having an antistatic type selective light absorption film as a second conventional example.
Figure 16:
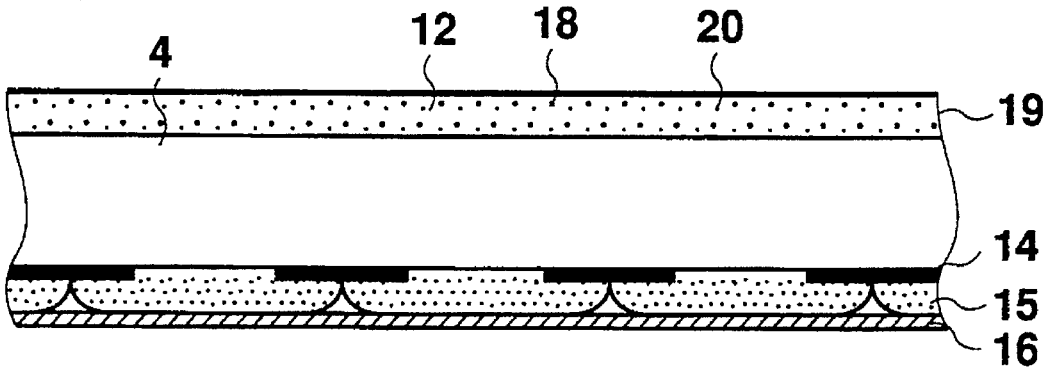
Fig. 16 PRIOR ART
FIG. 16 is a schematic enlarged sectional view of the structure of a phosphor screen having an antistatic type selective light absorption film or an antistatic type uniform light absorption film as a third conventional example.
Figure 20:
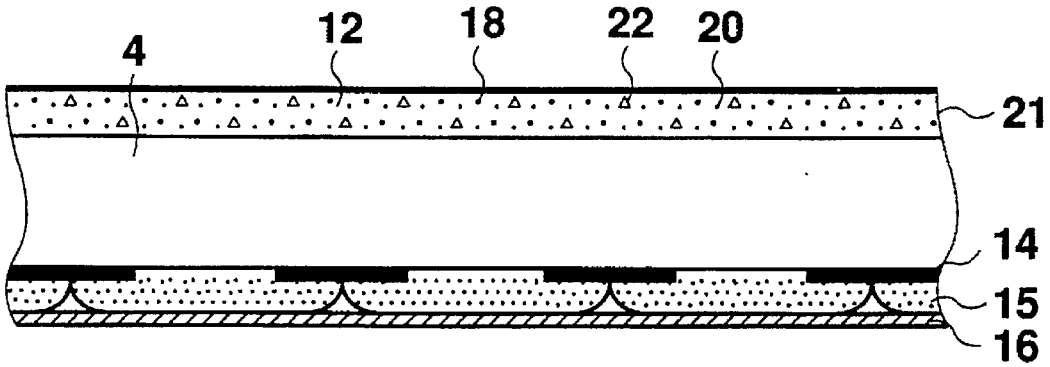
Fig. 20 PRIOR ART
FIG. 20 is a schematic enlarged sectional view of the structure of a phosphor screen having a monolayer antistatic type selective light absorption and low-reflection film or a monolayer antistatic type uniform light absorption and low-reflection film as a fourth conventional example.
Figure 22:
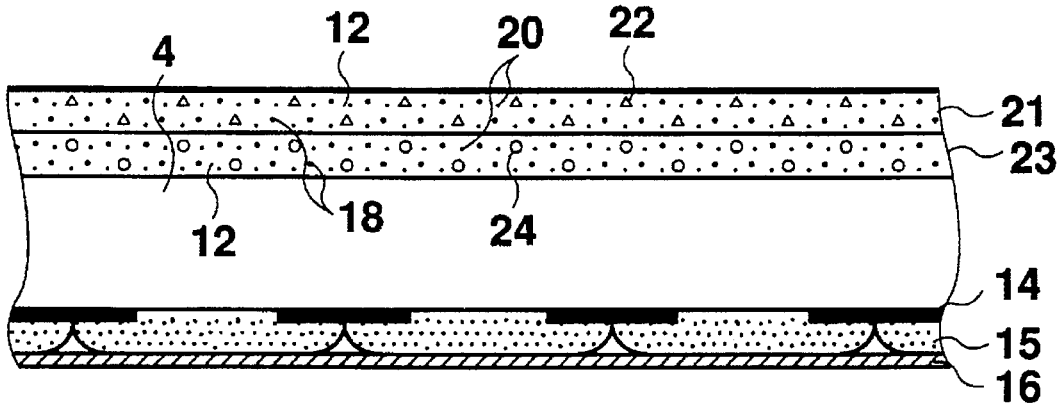
Fig. 22 PRIOR ART
FIG. 22 is a schematic enlarged sectional view of the structure of a phosphor screen having a multilayer antistatic type selective light absorption and low-reflection film or a multilayer antistatic type uniform light absorption and low-reflection film as the fifth conventional example.

Although an antistatic function is imparted to the functional films in the first to third embodiments by dispersing and mixing the conductive filler particles 18 in with the porous silica ($SiO_2$) film 12, the present invention is not restricted thereto. It is possible to form function films 28 to 30 having conductivity by using a porous silica film 27 containing water as a base and without adding the conductive filler particles 18 thereto as in the tenth to twelfth embodiments shown in FIGS. 10 to 12, respectively. The porous silica film 27 containing water is produced by taking in the water content in the porous silica ($SiO_2$) film 12 and in the air.

As described above, according to the present invention, among the various functions of the conventional functional film formed over the outer surface of a face plate, the selective light absorbing function is transferred to the selective light absorption layer provided between the inner surface of the face plate and the BGR phosphor layer provided on the inner surface of the face plate. It is therefore possible to reduce the number of kinds and amount of different material added to the functional film provided over the outer surface of the face plate. Since the strength of the functional film is lowered to a large extent when a functional film having various functions is provided over the face plate, the present invention is capable of ameliorating this defect without lowering the functions of the functional film. Consequently, it is possible to produce a high-quality color cathode ray tube which is unlikely to produce problems such as the problems of scratching the functional film formed over the outer surface of the face plate during use of the color television set, impairing the external appearance by the peeling-off of the functional film and influencing the definition of the image. The selective light absorption layer is realized by applying the particles of inorganic or organic pigment or dye to the inner surface of the face plate.

It is also possible to produce desired optical characteristics by using a mixture of the particles of at least two kinds of inorganic or organic pigment or dye. If the average particle diameter of the particles of inorganic or organic pigment or dye is set at not more than 1.0 μm, the selective light absorption layer formed from a uniform film is realized. If the spectral transmittance of the selective light absorption layer has at least two absorption peaks, it is possible to make the main absorption peak coincident with a range of a relatively high spectral luminous efficacy of human eyes and use a sub absorption peak as a means for controlling the original color of the phosphor screen itself. By providing an antistatic film, no discharge is generated when the viewer approaches the cathode ray tube even if it is used at a high voltage. In addition, if an optical monolayer low-reflection function as well as the selective light absorbing function is imparted to the cathode ray tube, a multi-function color cathode ray tube having both functions is realized. By providing an optical multilayer low-reflection film produced from between two and four optical interference films, a lower reflectivity is obtained. In addition, a multi-function color cathode ray tube having both the reflectivity lowering function and the antistatic function can also be realized.

According to the present invention, among the various functions of the conventional functional film formed over the outer surface of a face plate, the uniform light absorbing function is transferred to the neutral filter layer provided between the inner surface of the face plate and the BGR phosphor layer provided on the inner surface of the face plate. It is therefore possible to reduce the number of kinds and amount of different material added to the functional film provided over the outer surface of the face plate. Since the strength of the functional film is lowered to a large extent when a functional film having various functions is provided over the face plate, the present invention is capable of ameliorating this defect without lowering the functions of the functional film. Consequently, it is possible to produce a high-quality color cathode ray tube which is unlikely to produce problems such as the problems of scratching the functional film formed over the outer surface of the face plate during use of the color television set, impairing the external appearance by the peeling-off of the functional film and influencing the definition of the image.

It is possible to form a neutral filter layer from the particles of inorganic or organic pigment or dye by a coating process, for example.

If the neutral filter layer is formed from a mixture of the particles of at least two kinds of inorganic or organic pigment or dye, the optical characteristics which are difficult to realize using the neutral filter layer formed from the particles of one kind of inorganic or organic pigment or dye are obtained.

If the average particle diameter of the particles of inorganic or organic pigment or dye is set at not more than 1.0 μm, the neutral filter layer formed from a uniform film is realized.

By using graphite or carbon particles as inorganic pigment particles, it is easy to realize a color cathode ray tube having almost uniform spectral transmittance in the visible light region.

By providing an antistatic film on the outer surface of the face plate, it is possible to prevent inconvenience caused by discharges generated when the viewer approaches the cathode ray tube.

By providing an optical monolayer low-reflection film over the outer surface of the face plate, a multi-function color cathode ray tube having a reflectivity lowering function as well as the uniform light absorbing function is realized.

By providing an optical multilayer low-reflection film produced from between two and four optical interference films, a multi-function color cathode ray tube having the optical multilayer reflectivity lowering function as well as the uniform light absorbing function is realized.

In addition, if fine conductive particles are mixed with the low-reflection film, an antistatic function is added, thereby realizing a more excellent multi-function color cathode ray.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A color cathode ray tube comprising:

a face plate including an inner surface onto which electron beams are projected;

a transparent functional film formed on an outer surface of the face plate;

a tricolor phosphor layer, provided on the inner surface side of the face plate including red, green and blue phosphors which emit light when the electron beams are impinged thereon; and an intermediate layer, having predetermined optical characteristics, provided between the inner surface of the face plate and the tricolor phosphor layer, wherein the intermediate layer is a selective light absorption layer having a light absorption characteristic common to the red, green and blue phosphors.

2. The color cathode ray tube of claim 1, wherein the light absorption characteristic of the selective light absorption layer has three peaks:

a first peak being at a wavelength between a peak of a relative luminous intensity spectrum of the red phosphor and a peak of a relative luminous intensity spectrum of the green phosphor;

a second peak being at a wavelength between a peak of a relative luminous intensity spectrum of the green phosphor and a peak of a relative luminous intensity spectrum of the blue phosphor; and the third peak being at a wavelength lower than a peak of a relative luminous intensity spectrum of the blue phosphor.

3. The color cathode ray tube of claim 2, wherein the first peak is a main light absorption peak which has a relatively lower transmittance than the other two peaks.

4. The color cathode ray tube of claim 1, wherein the light absorption characteristic of the selective light absorption layer has two peaks:

a first peak being at a wavelength between a peak of relative luminous intensity spectrum of the red phosphor and a peak of a relative luminous intensity spectrum of the green phosphor; and the second peak being at a wavelength lower than a peak of a relative luminous intensity spectrum of the blue phosphor.

5. The color cathode ray tube of claim 4, wherein the first peak is a main light absorption peak which has a relatively lower transmittance than the second peak.

6. The color cathode ray tube of claim 1, wherein the intermediate layer includes particles of one selected from the group consisting of inorganic pigments, inorganic dyes, organic pigments and organic dyes as coloring particles.

7. The color cathode ray tube of claim 6, wherein the intermediate layer includes at least two kinds of coloring particles.

8. The color cathode ray tube of claim 7, wherein the kinds of coloring particles include at least one of graphite particles and carbon particles.

9. The color cathode ray tube of claim 6, wherein an average particle diameter of the coloring particles is at most 1.0 μm.

10. The color cathode ray tube of claim 1, wherein the intermediate layer is formed by applying a coating liquid, obtained by dispersing and mixing coloring particles in with a binder, to the inner surface of the face plate.

11. The color cathode ray tube of claim 1, wherein the transparent functional film is an antistatic film for releasing charges generated on the outer surface of the face plate.

12. The color cathode ray tube of claim 11, wherein the antistatic film is produced by dispersing and mixing fine conductive particles in with an $SiO_2$ transparent film.

13. The color cathode ray tube of claim 12, wherein the fine conductive particles include at least one of $SnO_2$ and $In_2O_3$.

14. The color cathode ray tube of claim 11, wherein the antistatic film is a transparent $SiO_2$ film containing water.

15. The color ray tube of claim 14, wherein the antistatic film is a porous transparent $SiO_2$ film containing water.

16. The color cathode ray tube of claim 14, wherein the water is absorbed from the air.

17. The color cathode ray tube of claim 1, wherein the transparent functional film includes a low-reflection film produced by applying a low-refraction base coating to the outer surface of the face plate.

18. The color cathode ray tube of claim 17, wherein the low-reflection film is formed to a constant film thickness by spin coating.

19. The color cathode ray tube of claim 17, wherein the transparent functional film includes a high-reflection film produced by applying a high-refraction base coating to the outer surface of the face plate.

20. The color cathode ray tube of claim 19, wherein the high-reflection film and the low-reflection film are laminated, alternately, on the outer surface of the face plate.

21. The color cathode ray tube of claim 19, wherein a total number of the high-reflection films and the low-reflection films is between two and four.

22. The color cathode ray tube of claim 17, wherein the low-reflection film contains fine conductive particles.

23. The color cathode ray tube of claim 22, wherein the fine conductive particles include at least one of $SnO_2$ and $In_2O_3$.

24. A color cathode ray tube comprising:

a face plate including an inner surface onto which electron beams are projected;

a transparent functional film formed on an outer surface of the face plate;

a tricolor phosphor layer, provided on the inner surface side of the face plate including red, green and blue phosphors which emit light when the electron beams are impinged thereon; and an intermediate layer, having predetermined optical characteristics, provided between the inner surface of the face plate and the tricolor phosphor layer, wherein the intermediate layer is a neutral filter layer having a uniform transmittance with respect to the light emitted from the red, blue and green phosphors.

* * * * *